United States Patent [19]

Waltenberger et al.

[11] 4,122,018

[45] Oct. 24, 1978

[54] SMOOTHING AGENTS FOR TREATING TEXTILE FIBER MATERIAL

[75] Inventors: Peter Waltenberger, Hilden; Günter Uphues, Dusseldorf; Manfred Petzold, Dusseldorf-Holthausen, all of Germany

[73] Assignee: Henkel Kommanditgesellschaft auf Aktien, Dusseldorf-Holthausen, Germany

[21] Appl. No.: 797,045

[22] Filed: May 16, 1977

[30] Foreign Application Priority Data

May 17, 1976 [DE] Fed. Rep. of Germany ..... 2621881

[51] Int. Cl.[2] ..... D06M 13/46

[52] U.S. Cl. ..... 252/8.6; 8/115.6; 252/8.8

[58] Field of Search ..... 252/8.6, 8.8; 8/115.6

[56] References Cited

U.S. PATENT DOCUMENTS

| | | | |
|---|---|---|---|
| 2,838,455 | 6/1958 | Tompkins | 252/8.6 |
| 3,658,717 | 4/1972 | Graff | 8/115.6 |
| 3,660,303 | 5/1972 | Hiestland | 8/115.6 |
| 3,674,418 | 7/1972 | Lyons et al. | 8/115.6 |
| 3,775,051 | 11/1973 | Graff | 8/115.6 |
| 3,888,775 | 6/1975 | Koizumi | 252/8.8 |
| 3,971,733 | 7/1976 | Hawkins | 252/8.6 |

*Primary Examiner*—William E. Schulz
*Attorney, Agent, or Firm*—Hammond & Littell

[57] ABSTRACT

A smoothing agent for the treatment of textile fiber material comprising (I) from 5 to 20% by weight of a higher fatty acid ester, (II) from 13 to 35% by weight of a paraffin, (III) from 1 to 10% by weight of a higher fatty acid amidopolyamine, (IV) from 0 to 5% by weight of higher fatty acid alkanolamides, (V) from 0 to 5% by weight of a quaternary ammonium salt, (VI) from 0 to 5% by weight of a nonionic ethoxylate, (VII) from 0 to 1% by weight of a protective colloid, (VIII) from 0 to 10% by weight of a water-immiscible organic solvent, (IX) from 1 to 10% by weight of a lower carboxylic acid or lower hydroxycarboxylic acid, and (X) the remainder to 100% by weight of water.

12 Claims, No Drawings

SMOOTHING AGENTS FOR TREATING TEXTILE FIBER MATERIAL

THE RELATED ART

A known method of improving the smoothness of textile fiber material is that of so-called dry-paraffining in which the yarn to be treated is guided over solid paraffin during the spooling operation. A quantity of paraffin, depending upon the type of paraffin, the contact pressure, and the speed of the material, is absorbed by the thread through abrading.

However, this method has substantial disadvantages. Thus, it is necessary to apply an accurately defined quantity of paraffin for the purpose of frictionless further processing of the textile material, different types of paraffin being used depending upon the time of the year. During spooling, it is necessary to reduce the normal spooling speed by 20 to 25%. Furthermore, the paraffined spools have to be stored at suitable temperatures.

During the paraffining operation, sliding of the individual strands of the yarn occur and the threads might break during processing of the yarn, particularly in the case of single ply yarns. A further disadvantage is the possible efflorescence of the paraffin during subsequent steaming and ironing processes.

Furthermore, the dry-praffining operation is generally inadequate to impart a satisfactory feel to the material. This requires additional treatment with a conventional cationic brightener or scrooping agent.

OBJECTS OF THE INVENTION

An object of the present invention is to develop an auxiliary agent which is suitable for treating the various textile fiber materials, such as cellulose fibers, wool fibers and synthetic fibers, or mixtures thereof, and which imparts to these materials the smoothness required for further processing and a satisfactory feel and antistatic effect.

Another object of the present invention is the development of a smoothing agent for the treatment of textile fiber material consisting essentially of:

(I) from 5 to 20% by weight of a fatty acid ester from 1 mol of a fatty acid having from 14 to 18 carbon atoms and 1 mol of an alcohol selected from the group consisting of alkanols having from 1 to 8 carbon atoms and alkanepolyols having from 2 to 8 carbon atoms, (II) from 15 to 35% by weight of paraffin having a melting range of from 40° C. to 60° C., where the total of components (I) and (II) is from 20 to 50% by weight, (III) from 1 to 10% by weight of at least one fatty acid amidopolyamine having the formula

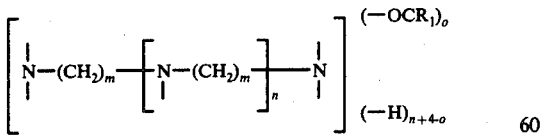

wherein $-OCR_1$ is the acyl of a fatty acid having from 14 to 22 carbon atoms, $m$ is an integer from 2 to 6, and $n$ and $o$ are numbers from 1 to 3, (IV) from 0 to 5% by weight of a fatty acid alkanolamide from 1 mol of a fatty acid having from 12 to 18 carbon atoms and an alkanolamine selected from the group consisting of 1 mol of a monoalkanolamine having from 2 to 3 carbon atoms and 1 to 2 mols of a dialkanolamine having from 4 to 6 carbon atoms, (V) from 0 to 5% by weight of at least one quaternary ammonium salt having the formula

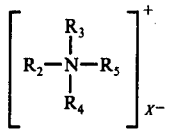

wherein $R_2$ is an aliphatic hydrocarbon having from 12 to 18 carbon atoms, $R_3$ is a member selected from the group consisting of aliphatic hydrocarbons having from 1 to 18 carbon atoms, phenylalkyl having from 7 to 18 carbon atoms and alkylphenylalkyl having from 8 to 18 carbon atoms, $R_4$ and $R_5$ are alkyl having 1 to 2 carbon atoms, and $X^-$ is a salt-forming anion, (VI) from 0 to 5% by weight of an ethylene oxide adduct to a compound having a replaceable hydrogen selected from the group consisting of aliphatic hydrocarbon alcohols having 9 to 22 carbon atoms, alkylphenols having from 12 to 20 carbon atoms, fatty acids having from 12 to 22 carbon atoms, higher fatty acid amides with alkylene diamines and dialkylene triamines having a total of from 12 to 22 carbon atoms, and alkylamines having from 12 to 22 carbon atoms, having from 35 to 85% by weight of ethylene oxide, where the total of components (III), (IV), (V) and (VI) is from 1 to 12% by weight, (VII) from 0 to 1% by weight of a protective colloid, (VIII) from 0 to 10% by weight of a water-immiscible organic solvent, (IX) from 1% to 10% by weight of an acid selected from the group consisting of alkanoic acids having from 1 to 4 carbon atoms and hydroxyalkanoic acids having from 2 to 4 carbon atoms, and (X) the remainder to 100% by weight, water.

These and other objects of the invention will become more apparent as the description thereof proceeds.

DESCRIPTION OF THE INVENTION

Accordingly the present invention provides a smoothing agent for textile fiber material having the following composition:

(I) 5 to 20% by weight of a fatty acid ester from 1 mol of a fatty acid having 14 to 18 carbon atoms and 1 mol of a mono- or polyhydric alcohol having 1 to 8 carbon atoms, (II) 15% to 35% by weight of paraffin having a melting range of from 40° to 60° C., the total of (I) and (II) being 20 to 50% by weight, (III) 1 to 10% by weight of fatty acid amidopolyamine of the general formula

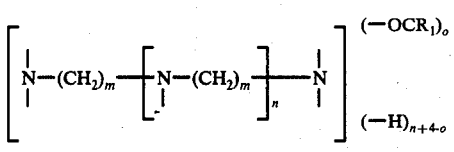

wherein —$OCR_1$ is the acyl of a fatty acid having 14 to 22 carbon atoms, $m = 2$ to 6, $n = 1$ to 3, and $o = 1$ to 3, (IV) 0 to 5% by weight of fatty acid monoalkanolamides or fatty acid dialkanolamides or fatty acid polydialkanolamides from 1 mol of a fatty acid having 12 to 18 carbon atoms and 1 mol of a monoalkanolamine having 2 to 3 carbon atoms or 1 or 2 mols of a dialkanolamine having 4 to 6 carbon atoms, (V) 0 to 5% by weight of a quaternary ammonium salt of the general formula

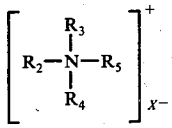

wherein $R_1$ is an aliphatic hydrocarbon radical having 12 to 18 carbon atoms, $R_3$ is an aliphatic or araliphatic hydrocarbon radical having 1 to 18 carbon atoms, $R_4$ and $R_5$ are hydrocarbon radicals having 1 to 2 carbon atoms, and $X^-$ is a salt-forming anion, (VI) 0 to 5% by weight of an ethyleneoxide adduct onto higher alcohols having 9 to 22 carbon atoms or to alkylphenols having 12 to 20 carbon atoms or to higher fatty acids or fatty acid amidopolyamines or alkylamines having 12 to 22 carbon atoms, the total of (III), (IV), (V) and (VI) being 1 to 12% by weight, (VII) 0 to 1% by weight of a protective colloid, (VIII) 0 to 10% by weight of a water-immiscible solvent (IX) 1 to 10% by weight of a lower carboxylic acid or hydroxycarboxylic acid having 1 to 4 carbon atoms, (X) remainder up to 100% by weight, water.

More particularly, the present invention relates to a smoothing agent for the treatment of textile fiber material consisting essentially of:

(I) from 5 to 20% by weight of a fatty acid ester from 1 mol of a fatty acid having from 14 to 18 carbon atoms and 1 mol of an alcohol selected from the group consisting of alkanols having from 1 to 8 carbon atoms and alkanepolyols having from 2 to 8 carbon atoms, (II) from 15 to 35% by weight of paraffin having a melting range of from 40° C. to 60° C., where the total of components (I) and (II) is from 20% to 50% by weight, (III) from 1 to 10% by weight of at least one fatty acid amidopolyamine having the formula

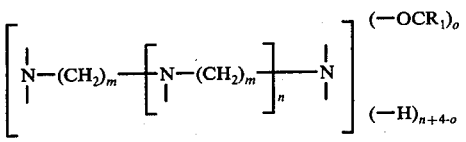

wherein —$OCR_1$ is the acyl of a fatty acid having from 14 to 22 carbon atoms, $m$ is an integer from 2 to 6, and $n$ and $o$ are numbers from 1 to 3, (IV) from 0 to 5% by weight of a fatty acid alkanolamide from 1 mol of a fattyy acid having from 12 to 18 carbon atoms and an alkanolamine selected from the group consisting of 1 mol of a monoalkanolamine having from 2 to 3 carbon atoms and 1 to 2 mols of a dialkanolamine having from 4 to 6 carbon atoms, (V) from 0 to 5% by weight of at least one quaternary ammonium salt having the formula

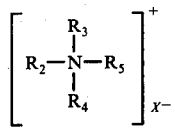

wherein $R_2$ is an aliphatic hydrocarbon having from 12 to 18 carbon atoms, $R_3$ is a member selected from the group consisting of aliphatic hydrocarbons having from 1 to 18 carbon atoms, phenylalkyl having from 7 to 18 carbon atoms and alkylphenylalkyl having from 8 to 18 carbon atoms, $R_4$ and $R_5$ are alkyl having 1 to 2 carbon atoms, and $X^-$ is a salt-forming anion, (VI) from 0 to 5% by weight of an ethylene oxide adduct to a compound having a replaceable hydrogen selected from the group consisting of aliphatic hydrocarbon alcohols having 9 to 22 carbon atoms, alkylphenols having from 12 to 20 carbon atoms, fatty acids having from 12 to 22 carbon atoms, higher fatty acid amides with alkylene diamines and dialkylene triamines having a total of from 12 to 22 carbon atoms, and alkylamines having from 12 to 22 carbon atoms, having from 35 to 85% by weight of ethylene oxide, where the total of components (III), (IV), (V) and (VI) is from 1 to 12% by weight, (VIII) from 0 to 1% by weight of a protective colloid, (VIII) from 0 to 10% by weight of a water-immiscible organic solvent, (IX) from 1 to 10% by weight of an acid selected from the group consisting of alkanoic acids having from 1 to 4 carbon atoms and hydroxyalkanoic acids having from 2 to 4 carbon atoms, and (X) the remainder to 100% by weight, water.

In addition, the present invention relates to an improvement in the treatment of textile fiber material to provide a smooth finish by the application of a smoothing agent, the improvement consisting of using the above smoothing agent.

Smoothing agents of the following composition are preferred:

(I) 7.5 to 20.0% by weight of the fatty acid ester, (II) 20.0 to 30.0% by weight of the paraffin, (III) 2.8 to 6.0% by weight of the fatty acid amidopolyamine, (IV) 0 to 1.5% by weight of the fatty acid dialkanolamide or polydialkanolamide, (V) 0 to 2.0% by weight of the quaternary ammonium salt, (VI) 0.1 to 0.5% by weight of an adduct of 35 to 85% by weight of ethylene oxide adducted to a higher fatty alcohol having 16 to 18 carbon atoms, or to nonylphenol, (VII) 0 to 0.1% by weight of a protective colloid, (VIII) 0 to 4% by weight of a water-immiscible organic solvent, (IX) 3 to 8% by weight of concentrated acetic acid, (X) remainder to 100% by weight, water.

These smoothing agents constitute storage-stable aqueous dispersions whose specific substantivity especially enables the smoothing agents to be applied to fibers by the bath exhaustion method.

Suitable fatty acid esters of component (I) are fatty acid esters from 1 mol of a fatty acid having from 14 to 18 carbon atoms and 1 mol of an alcohol selected from the group consisting of alkanols having from 1 to 8 carbon atoms and alkanepolyols having from 2 to 8 carbon atoms, in particular, methyl palmitate or methyl stearate, and the corresponding ethyl esters. Fatty acids include the iso acids such as isopalmitic acid. However, it is also possible to use partial esters of ethyleneglycol, propyleneglycol, glycerine, pentaerythrite or sorbitol, such as palmitic acid monoglyceride or stearic acid monoglyceride.

The paraffins (II) used are preferably those having a melting range of from 50° C. to 60° C.

The fatty acid amidopolyamides of component (III) are obtained preferably from saturated fatty acids or mixtures of fatty acids having 16 to 22 carbon atoms with polyalkylene polyyamines having the formula $$H_2N-(CH_2)_m-\left[NH-CH_2)_m\right]_n-NH_2$$

wherein $m$ and $n$ have the above-assigned values, such as diethylene triamine, dipropylene triamine, triethylene tetraamine, tripropylene tetraamine, tetraethylene pentamine and tetrapropylene pentamine. The reaction is effected in a molar ratio such that at least one amino nitrogen atom, capable of salt formation, remains. The product of reaction from 2 mols of stearic acid with 1 mol of diethylenetriamine may be mentioned by way of example. The fatty acid amidopolyamines in the smoothing agent composition of the invention are present in the form of salts thereof with lower carboxylic acids or hydroxycarboxylic acids having 1 to 4 carbon atoms, such as acetic acid or glycolic acid, presented as component (IX).

Fatty acid monoalkanolamides or fatty acid dialkanolamides or fatty acid polydialkanolamides corresponding to component (IV) are obtained by condensation of 1 mol of a monoalkanolamine or 1 to 2 mols of a dialkanolamine, such as monoethanolamine or diethanolamine or dipropanolamine with 1 mol of fatty acid, mixtures of fatty acids or the corresponding fatty acid methyl esters, such as fatty acids having 12 to 20 carbonatoms (see Lindner, "Tenside-Textilhilfsmittel-Waschrohstoffe" [1967] pages 904 to 912). Examples of these are the condensation products from 1 mol of lauric acid and 1 mol of monoethanolamine, from 1 mol of coconut fatty acid and 2 mols of diethanolamine, from 1 mol of lauric acid or oleic acid and 1 mol of diethanolamine, or from 1 mol of coconut fatty acid and 1 mol of dipropanolamine.

Suitable quaternary ammonium salts of component (V) are those of the formula

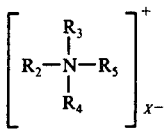

wherein $R_2$ is an aliphatic hydrocarbon having from 12 to 18 carbon atoms, particularly alkyl and alkenyl, $R_3$ is a member selected from the group consisting of aliphatic hydrocarbons having from 1 to 18 carbon atoms, particularly alkyl having from 1 to 18 carbon atoms and alkenyl having from 2 to 18 carbon atoms, phenylalkyl having from 7 to 18 carbon atoms, particularly benzyl, and alkylphenylalkyl having from 8 to 18 carbon atoms, $R_4$ and $R_5$ are methyl or ethyl, and $X^-$ is a salt-forming anion, particularly a halide, a methosulfate or an ethosulfate. The following are representative quaternary ammonium compounds: Lauryltrimethyl ammonium chloride, dodecylbenzyltrimethyl ammonium methosulfate or distearyl-dimethyl-ammonium chloride.

The smoothing agent compositions also can contain from 0 to 5% by weight, preferably 0.1 to 0.5%, by weight of an ethylene oxide adduct to a compound having a replaceable hydrogen and at least 9 carbon atoms, such as straight or branched chain, saturated or unsaturated higher alcohols having 9 to 22, preferably 16 to 18, carbon atoms, particularly alkanols and alkenols, such as the adduct of 20 mols of ethylene oxide to 1 mol of oleyl alcohol or to alkylphenols having 12 to 20 carbon atoms, such as the adduct of 10 mols of ethylene oxide to nonylphenol or to higher fatty acids having 12 to 22 carbon atoms, such as the adduct of 15 mols of ethylene oxide to tallow fatty acids, or to fatty acid amidopolyamines or alkylamines having 12 to 22 carbon atoms, or mixtures of these adducts. The ethylene oxide content of the adducts should be 35 to 85% by weight. The ethylene oxide adducts to higher fatty alcohols and alkylphenols are preferred, as component (VI).

The protective colloids of component (VII) are preferably cellulose ethers, such as methylcellulose or hydroxyethylcellulose, glue, polyvinyl alcohol or gum arabic.

Suitable solvents of component (VIII) which are immiscible in water are the aliphatic or aromatic hydrocarbons having 5 to 10 carbon atoms, such as hexane, benzene, toluene, xylene, alkylbenzene; symmetric or asymmetric ketones, particularly lower alkanones, such as diisobutylketone, symmetric or asymmetric ethers, particularly lower alkyl ethers, such as dibutyl ether, or halogenated hydrocarbons, such as trichloroethylene or perchloroethylene.

The lower carboxylic acids of component (IX) serve to form salts with the fatty acid amidopolyamines or to neutralize other basic constituents of the composition and, advantageously, should be used in a quantity of from 3 to 6 mols per amino nitrogen equivalent. Preferably these acids are alkanoic acids having from 1 to 4 carbon atoms and hydroxyalkanoic acids having from 2 to 4 carbon atoms. By way of example, acetic acid or glycolic acid are suitable.

The composition is made up to 100% by weight with water (X) and is converted into a stable dispersion. This can be effected in a conventional manner by agitation, at elevated temperatures, if required, with the use of agitators, dispersers, homogenizers, etc. Preferably, distilled or demineralized water is used.

The smoothing agents, claimed in accordance with the invention, can be used for the finishing of textile fiber materials, such as wool, cotton, rayon, polyacrylonitrile fiber, polyester fiber, polyamide fiber, triacetate fiber, polyethylene fiber, or polypropylene fiber materials and mixtures thereof, preferably mixtures of polyacrylonitrile/wool, polyacrylonitrile/cotton, polyester/wool, polyester/rayon and polyamide/wood, and mixtures of mineral fiber material, such as asbestos or glass fibers, preferably glass fiber material. Preferably, the fiber materials are present in the form of cross-wound bobbins, rocket bobbins, hank yarn, muffs or combed sliver or slubbing.

The material may be bleached, dyed and/or finished so as to be shrink free.

The smoothing agents can be applied in conventional apparatus, such as dyeing apparatus for cross-wound bobbins, rocket bobbins, hank yarn, muffs or on the backwashing machine for combed sliver. Advantageously, work is carried out by the bath exhaust process from an aqueous liquor with a goods/liquor ratio of 1:8 to 1:40 and a liquor pH of 2 to 8, preferably 4.5 to 6.5, in an HT apparatus, or 6.5 to 7.5 in open apparatus, at a temperature between 25° C. and 80° C., the concentration being 0.2 to 3.0%, preferably 0.2 to 1.5%, by weight of smoothing agent, based on the active smoothing agent substances relative to the weight of the goods.

Finishing can also be effected in the presence of electrolytes, such as sodium acetate, sodium sulfate, sodium chloride, etc.

The finished material has excellent smoothness, and a soft, voluminous and supple feel, so that there is no need for an additional application of scrooping agents. The smoothness values or friction values, measured on the friction value balance manufactured by the firm Schlafhorst, are below 0.18 My in all the textile fiber materials, preferably 0.12 to 0.15 My, and have a high degree of uniformity. This results in very satisfactory workability when, for example, knitting or weaving. Furthermore, no difficulties are caused by electrostatic charging when further processing the finished textile fiber materials. The knitted and woven articles made from yarns of this type exhibit satisfactory and smooth stitches.

The present invention will now be further described by means of the following examples of smoothing agents made in accordance with the present invention and their uses. These examples are not to be deemed limitative of the invention in any respect.

EXAMPLES

Examples 1 to 9 are examples of various smoothing agent compositions of the invention.

EXAMPLE 1

| | Percent by Weight | Component |
|---|---|---|
| Methyl palmitate | 10.0 | I |
| Paraffin, m.p. 52° to 54° C | 30.0 | II |
| Fatty acid amidopolyamine of the formula, wherein —$OCR_1$ is the acyl of a fatty acid having the chain distribution: $C_{16}$ = 25%, $C_{18}$ = 35%, $C_{20}$ = 15%, $C_{22}$ = 25%, m = 2, n = 2, o = 2 | 2.8 | III |
| Fatty acid alkanolamide from 1 mol of coconut fatty acids and 2 mols of diethanolamine | 1.5 | IV |
| Diisobutyl ketone | 2.0 | VIII |
| Acetic acid, concentrated | 3.0 | IX |
| Water | 50.7 | X |

The ingredients were mixed and dispersed to form a stable, aqueous dispersion.

EXAMPLE 2

| | Percent by Weight | Component |
|---|---|---|
| Methyl palmitate | 15.0 | I |
| Paraffin, m.p. 57° to 60° C | 15.0 | II |
| Fatty acid amidopolyamine of the formula, wherein —$OCR_1$ is the acyl of a fatty acid having the chain distribution: $C_{16}$ = 20%, $C_{18}$ = 40%, $C_{20}$ = 10%, $C_{22}$ = 30%, m = 2, n = 3, o = 3 | 3.7 | III |
| Lauric acid diethanolamide | 0.75 | IV |
| Acetic acid, 60% | 6.3 | IX |
| Water | 59.2 | X |

EXAMPLE 3

| | | |
|---|---|---|
| Methyl isopalmitate | 7.5 | I |
| Paraffin, m.p. 52° to 54° C | 22.5 | II |
| Fatty acid amidopolyamine of Example 2 | 4.5 | III |
| Perchloroethylene | 4.0 | VIII |
| Acetic acid, concentrated | 3.0 | IX |
| Water | 58.5 | X |

EXAMPLE 4

| | Percent by Weight | Component |
|---|---|---|
| Methyl stearate | 10.0 | I |
| Paraffin, m.p. 52° to 54° C | 30.0 | II |
| Fatty acid amidopolyamine of the formula, wherein —$OCR_1$ is the acyl of a fatty acid having the chain distribution: $C_{16}$ = 25%, $C_{18}$ = 35%, $C_{20}$ = 15%, $C_{22}$ = 25%, m = 2, n = 3, o = 2.5 | 4.5 | III |
| Oleic acid diethanolamide | 1.5 | IV |
| Toluene | 4.0 | VIII |
| Acetic acid, concentrated | 3.4 | IX |
| Water | 46.6 | X |

EXAMPLE 5

| | | |
|---|---|---|
| Methyl palmitate | 8.75 | I |
| Paraffin, m.p. 52° to 54° C | 26.25 | II |
| Fatty acid amidopolyamine of Example 2 | 3.5 | III |
| Coconut fatty acid monoethanolamide | 0.7 | IV |
| Gum arabic, 1% solution | 8.75 | VII |
| Acetic acid, 60% solution | 4.9 | IX |
| Water | 47.15 | X |

EXAMPLE 6

| | Percent by Weight | Component |
|---|---|---|
| Methyl palmitate | 10.0 | I |
| Paraffin, m.p. 52° to 54° C | 30.0 | II |
| Fatty acid amidopolyamine of Example 2 | 3.5 | III |
| Fatty acid alkanolamide from 1 mol of coconut fatty acid and 2 mols of diethanolamine | 1.5 | IV |
| Lauryltrimethyl ammonium chloride, 35% solution | 2.0 | V |
| Acetic acid, 60% solution | 5.9 | IX |
| Water | 47.1 | X |

EXAMPLE 7

| | | |
|---|---|---|
| Methyl palmitate | 11.0 | I |
| Paraffin, m.p. 52° to 54° C | 24.0 | II |
| Fatty acid amidopolyamine of Example 2 | 4.4 | III |

-continued

| | | |
|---|---|---|
| Fatty acid alkanolamide from 1 mol of coconut fatty acid and 2 mols of diethanolamine | 1.0 | IV |
| Nonylphenol adducted with 10 mols of ethylene oxide | 0.3 | VI |
| Acetic acid, concentrated | 4.2 | IX |
| Water | 55.1 | X |

EXAMPLE 8

| | Percent by Weight | Component |
|---|---|---|
| 2-Ethylhexyl stearate | 8.75 | I |
| Paraffin, m.p. 52° C to 54° C | 26.25 | II |
| Fatty acid amidopolyamine of Example 1 | 4.4 | III |
| Fatty acid alkanolamide from 1 mol of lauric acid and 2 mols of diethanolamide | 1.0 | IV |
| Acetic acid, 60% solution | 6.7 | IX |
| Water | 52.9 | X |

EXAMPLE 9

| | | |
|---|---|---|
| Methyl palmitate | 7.5 | I |
| Paraffin, m.p. 52° C to 54° C | 22.5 | II |
| Fatty acid amidopolyamine of Example 2 | 4.0 | III |
| Distearyldimethyl ammonium chloride | 1.4 | V |
| Acetic acid, 60% solution | 4.5 | IX |
| Water | 60.1 | X |

The smoothing agents of Examples 1 to 9 are stable dispersions which are miscible with water in any ratio.

The following are examples of the use of the smoothing agents of the invention.

EXAMPLE 10

Highly swollen polyacrylonitrile yarn, which had previously been dyed in a conventional manner with cationic combinations of dyes and which had been cold-rinsed to 50° C., was treated for 15 minutes in a hank dyeing apparatus in a liquor ratio of 1:25 with a liquor which had been adjusted to a pH value of 7 to 7.5 and which contained 1.5% of the smoothing agent of Example 1, based on the weight of the goods. During this period of time, all the smoothing agent was exhausted and attached to the fibrous material. The material was subsequently centrifuged and dried.

The yarn finished in this manner had very satisfactory smoothness (friction value = 0.15 My), a soft feel and could be knitted without any after-treatment.

The knitted article was distinguished by very uniform stitches.

EXAMPLE 11

After having been dyed, a mixed yarn comprising polyacrylonitrile and wool was treated for 20 minutes with 2.0%, based on the weight of the goods, of the smoothing agent of Example 2 in a fresh bath with a liquor ratio of 1:10, and at a pH value of 5.0 in a cross-wound bobbin HT dyeing apparatus with increasing temperature (to 45/50° C.) and was then centrifuged and dried.

The material exhibited excellent smoothness (friction value 0.14 My) and could be readily further processed. The knitted article made from the material had a voluminous feel without any additional brightening treatment and was free from nebs.

EXAMPLE 12

Wool yarn 32/2 on a rocket bobbin, felt-free finished and reactively dyed, was treated for 20 minutes at 40° C. with a liquor containing 2%, based on the weight of the goods, of the smoothing agent of Example 3 in the liquor ratio of 1:12 and a liquor pH value of 6.0, and was then centrifuged and dried.

The material finished in this manner showed a very uniform deposit of the smoothing agent and could be further processed in a trouble-free manner to provide a high-quality knitted article.

EXAMPLE 13

After thorough deacidification, a cotton material dyed with indanthrene (R) was treated for 10 minutes at 45° C. in an open dyeing apparatus with a liquor (liquor pH value 5.5) containing 1.5% of the smoothing agent of Example 4 (based on the weight of the goods). The smoothing agent was extensively attached to the fibrous material with excellent uniformity.

The material was centrifuged, dried, and wound onto "9° 15′ bobbins".

The drying operation was carried out in a rapid drier at 120° C., and the smoothing agent did not evaporate.

EXAMPLE 14

Hand-knitting yarn comprising 80% polyacrylonitrile and 20% wool (mohair) was treated for 20 minutes at 45° C. in a hank yarn dyeing apparatus with a liquor containing 1.5%, based on the weight of the goods, of the smoothing agent of Example 1 with the liquor ratio 1:30 and a pH value of 7.0 and was then centrifuged and dried.

The resultant material exhibited excellent smoothness (friction value = 0.16 My) and could be wound into a ball without trouble caused by electrostatic charges.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A smoothing agent for the treatment of textile fiber material consisting essentially of:

(I) from 5 to 20% by weight of a fatty acid ester from 1 mol of a fatty acid having from 14 to 18 carbon atoms and 1 mol of an alcohol selected from the group consisting of alkanols having from 1 to 8 carbon atoms and alkanepolyols having from 2 to 8 carbon atoms, (II) from 15 to 35% by weight of paraffin having a melting range of from 40° C. to 60° C., where the total of components (I) and (II) is from 20 to 50% by weight, (III) from 1% to 10% by weight of at least one fatty acid amidopolyamine having the formula

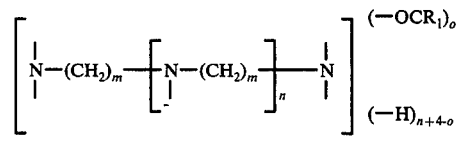

wherein —$OCR_1$ is the acyl of a fatty acid having from 14 to 22 carbon atoms, *m* is an integer from 2 to 6, and *n* and *o* are numbers from 1 to 3, (IV) from 0 to 5% by weight of a fatty acid alkanolamide from 1 mol of a fatty acid having from 12 to 18 carbon atoms and an alkanolamine selected from the group consisting of 1 mol of a monoalkanolamine having from 2 to 3 carbon atoms and 1 to 2 mols of a dialkanolamine having from 4 to 6 carbon atoms, (V) from 0 to 5% by weight of at least one quaternary ammonium salt having the formula

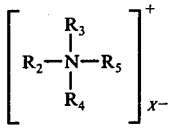

wherein $R_2$ is an aliphatic hydrocarbon having from 12 to 18 carbon atoms, $R_3$ is a member selected from the group consisting of aliphatic hydrocarbons having from 1 to 18 carbon atoms, phenylalkyl having from 7 to 18 carbon atoms and alkylphenylalkyl having from 8 to 18 carbon atoms, $R_4$ and $R_5$ are alkyl having 1 to 2 carbon atoms, and $X^-$ is a salt-forming anion, (VI) from 0 to 5% by weight of an ethylene oxide adduct to a compound having a replaceable hydrogen selected from the group consisting of aliphatic hydrocarbon alcohols having 9 to 22 carbon atoms, alkylphenols having from 12 to 20 carbon atoms, fatty acids having from 12 to 22 carbon atoms, higher fatty acid amides with alkylene diamines and dialkylene triamines having a total of from 12 to 22 carbon atoms, and alkylamines having from 12 to 22 carbon atoms, having from 35 to 85% by weight of ethylene oxide, where the total of components (III), (IV), (V) and (VI) is from 1 to 12% by weight, (VII) from 0 to 1% by weight of a protective colloid, (VIII) from 0 to 10% by weight of a water-immiscible organic solvent, (IX) from 1 to 10% by weight of an acid selected from the group consisting of alkanoic acids having from 1 to 4 carbon atoms and hydroxyalkanoic acids having from 2 to 4 carbon atoms, and (X) the remainder to 100% by weight, water.

2. The smoothing agent of claim 1 wherein said component (I) is a fatty acid ester from 1 mol of a fatty acid having from 14 to 18 carbon atoms and 1 mol of an alkanol having from 1 to 8 carbon atoms.

3. The smoothing agent of claim 2 wherein said fatty acid ester is a member selected from the group consisting of a methyl palmitate, methyl isopalmitate and methyl stearate.

4. The smoothing agent of claim 1 wherein said component (II) is a paraffin having a melting range of from 50° C. to 60°.

5. The smoothing agent of claim 1 wherein said component (III) is a fatty acid amidopolyamine where —$OCR_1$ is the acyl of mixed fatty acids having 16 to 22 carbon atoms.

6. The smoothing agent of claim 1 wherein:

component I is present in an amount of 7.5 to 20.0% by weight, component II is present in an amount of 20.0 to 30.0% by weight, component III is present in an amount of 2.8 to 6.0% by weight, component IV is present in an amount of 0 to 1.5% by weight, component V is present in an amount of 0 to 2.0% by weight, component VI is present in an amount of 0.1 to 0.5% by weight, component VII is present in an amount of 0 to 0.1% by weight, component VIII is present in an amount of 0 to 4.0% by weight, component IX is present in an amount of 3.0 to 8.0% by weight.

7. The smoothing agent of claim 6 wherein said component VI is an ethylene oxide adduct on an alkanol having 16 to 18 carbon atoms.

8. The smoothing agent of claim 6 wherein said component VI is an ethylene oxide adduct on a nonylphenol having 16 to 18 carbon atoms.

9. In the process of treating textile fiber material to lubricate the same comprising the steps of contacting a textile fiber material with a smoothing agent and recovering said lubricated textile fiber material, the improvement consisting of using from 0.2 to 3.0%, based on the active smoothing agent substances relative to the weight of the goods, of the smoothing agent of claim 1, as said smoothing agent.

10. The process of claim 9 wherein said smoothing agent is contacted with said textile fiber material by the bath exhaustion method.

11. The process of claim 9 wherein said smoothing agent is contacted with said textile fiber material by a spraying process.

12. The process of claim 9 wherein said smoothing agent is contacted with said textile fiber material by an immersion process.

* * * * *